US005374050A

United States Patent [19]

Prim

[11] Patent Number: 5,374,050

[45] Date of Patent: Dec. 20, 1994

[54] JOGGER HAVING A FLOATING MOUNT

[75] Inventor: John E. Prim, West Chazy, N.Y.

[73] Assignee: Prim Hall Enterprises, Inc., Plattsburgh, N.Y.

[21] Appl. No.: 71,530

[22] Filed: Jun. 3, 1993

[51] Int. Cl.[5] ..... B65H 31/36

[52] U.S. Cl. ..... 271/221; 271/223; 414/917

[58] Field of Search ..... 271/149, 150, 213, 221, 271/222, 223; 414/917

[56] References Cited

U.S. PATENT DOCUMENTS

| | | | |
|---|---|---|---|
| 360,921 | 4/1887 | Sedgwick | 271/222 |
| 3,831,784 | 8/1974 | Newell | 271/221 X |
| 4,178,118 | 12/1979 | Bailey | 271/221 X |
| 4,973,038 | 11/1990 | Curley et al. | 271/221 X |
| 5,203,837 | 4/1993 | Madic et al. | 414/917 X |

*Primary Examiner*—Robert P. Olszewski
*Assistant Examiner*—Boris Milef
*Attorney, Agent, or Firm*—Louis Weinstein

[57] ABSTRACT

A jogger having a jogger plate is floatingly supported by a four-bar linkage swingably mounted upon a support post. The four-bar linkage is a parallelogram-type linkage which enables the jogger plate to maintain its orientation in space regardless of any swinging movement experienced by the parallelogram linkage. An adjustable weight is provided to control the force exerted upon a signature stack during operation. The jogger plate is adjustable to provide proper positioning of the plate relative to the stack being jogged into alignment. Sensors control the operation of the jogger assembly responsive to the presence of a stack to be jogged and responsive to the movement of the jogging assembly to a given position displaced from the nominal operating position.

20 Claims, 5 Drawing Sheets

JOGGER HAVING A FLOATING MOUNT

CROSS-REFERENCE TO RELATED APPLICATIONS

This application is related to copending application Ser. No. 978,994, filed Nov. 19, 1992, now U.S. Pat. No. 5,310,172, and application Ser. No. 693,638, filed Apr. 30, 1991, now U.S. Pat. No. 5,197,590, issued Mar. 30, 1993, both of said documents being assigned to the assignee of the present invention.

FIELD OF THE INVENTION

The present invention relates to joggers and more particularly to a novel floating mount for devices such as joggers for regulating the force applied to the top edges of signatures being jogged into alignment and preventing signatures from being curled.

BACKGROUND OF THE INVENTION

Vertical hopper loaders are well known in the art and are typically used in the printing and publishing field and are utilized to form neatly aligned stacks of signatures preparatory to being fed to saddle conveyors, bindery machines and the like. One typical hopper loader which may use the present invention to great advantage is described in copending application Ser. No. 978,994, filed Nov. 19, 1992 and assigned to the assignee of the present invention. For purposes of understanding the present invention, the vertical hopper loader of application Ser. No. 978,994, receives stacks of signatures typically manually placed upon a first, horizontal conveyor section. The signatures are tilted over so as to be substantially diagonally aligned and in a near-vertical position and are thereafter moved along a diagonally aligned conveyor path formed by a ramp conveyor section which causes the signatures to be fed in a shingle fashion at a speed which is the same as or faster than the speed of the horizontal conveyor with the folded edges extending upwardly and being spaced by an increased distance from the folded edge of adjacent signatures due to the diagonally upward movement. The conveyor path then changes whereupon the lower edges of the signatures are moved along a third, short conveyor path aligned so as to move the lower edges of the signatures either horizontally or diagonally downwardly toward a collection device typically inclined at an acute angle to the vertical.

As the signatures are advanced along the third, short conveyor path by virtue of a conveyor means engaging and driving the bottom edges of the signatures engaging the conveyor means to advance the signatures to the output utilization device, it is advantageous to provide a jogging means for jogging the top edges of the signatures to form a neat stack preparatory to delivery to the output utilization means to assure proper feeding.

Jogging is typically accomplished by employment of jogging means such as a beaver-tail jogger described in the aforementioned U.S. Pat. No. 5,197,590. Such beaver-tail joggers are adjustable, typically in at least two mutually perpendicular directions, to adjust the beaver-tail plate which undergoes oscillation to jog the stack of signatures therebeneath by repeated engagement with the upper folded edges of the signatures as they move along the third conveyor path.

Conventional beaver-tail joggers of the type described in U.S. Pat. No. 5,197,590 have the disadvantage of being substantially fixed in space, once adjusted, so that signatures may be damaged or unnecessarily curled and/or the beaver-tail jogger drive assembly may be overloaded and possibly damaged due to changes in the nominal position of the top folded edges of the signatures.

BRIEF DESCRIPTION OF THE INVENTION

The present invention is characterized by comprising a novel four-bar parallelogram-type linkage assembly for floatingly mounting jogger assemblies and the like. The jogger assembly is swingably mounted upon a support post which serves as one "bar" of the four-bar assembly. First ends of a second "bar" and a third "bar" are swingably mounted to said post and a fourth "bar" has its ends pivotally coupled to the free ends of said second and third bars. A jogger assembly is coupled to the fourth bar by adjustable means for adjusting the position and angular orientation of the beaver-tail jogging plate relative to the top folded edges of a stack of forming signatures.

The aforementioned second bar is provided with an extension that extends away from the jogger assembly and which is provided with a mass which is movable along a slidable mount provided on the extension and includes releasable fastening means for maintaining the slidable mass in a predetermined position, said slidable mass at least partially counterbalancing the weight of the jogger assembly by an amount which is a function of weight of the mass and the position of the slidable mass along the extension rod.

Once the jogging plate is positioned at the desired orientation, the four-bar linkage assures that the jogging plate thereafter remains parallel to its original orientation regardless of any swinging movement up or down experienced by the linkage assembly. The weight or force of the jogging plate upon the top folded edges of the signatures is dynamically adjusted in the event that any changes occur in the position or positions of the top folded edges of signatures conveyed to the third and final conveying path of the hopper loader. This arrangement also operates as a safety feature which permits movement of the jogger assembly responsive to any impediment which may strike or be struck by the jogger plate and/or jogger.

Adjustably mounted sensing means is provided to activate the jogger assembly only in the presence of a signature stack to be jogged. Further sensing means are provided to deactivate the jogger assembly when the jogging assembly is lifted to a given position displaced from the nominal stack jogging position.

OBJECTS OF THE INVENTION

It is therefore one object of the present invention to provide a novel mounting assembly for floatingly mounting jogging assemblies and the like.

Still another object of the present invention is to provide a novel four-bar linkage for floatingly mounting jogger assemblies and the like.

Still another object of the present invention is to provide a novel mounting assembly for floatingly mounting beaver-tail joggers and the like.

Still another object of the present invention is to provide a novel assembly for floatingly mounting joggers, jogger assemblies and the like and incorporating a slidably mounted mass for adjusting the force exerted by the jogger assembly upon a stack of signatures being formed on an outfeed conveyor.

The above, as well as other objects of the present invention will become apparent when reading the accompanying description and drawings, in which:

BRIEF DESCRIPTION OF THE FIGURES

FIG. 2*a* is a detailed exploded perspective view of the support assembly of FIG. 1;

FIG. 2*c* is a perspective view of guard plates employed with the floating support assembly of FIG. 2*a.

DETAILED DESCRIPTION OF THE INVENTION AND PREFERRED EMBODIMENTS THEREOF

Figures 1, 1A:
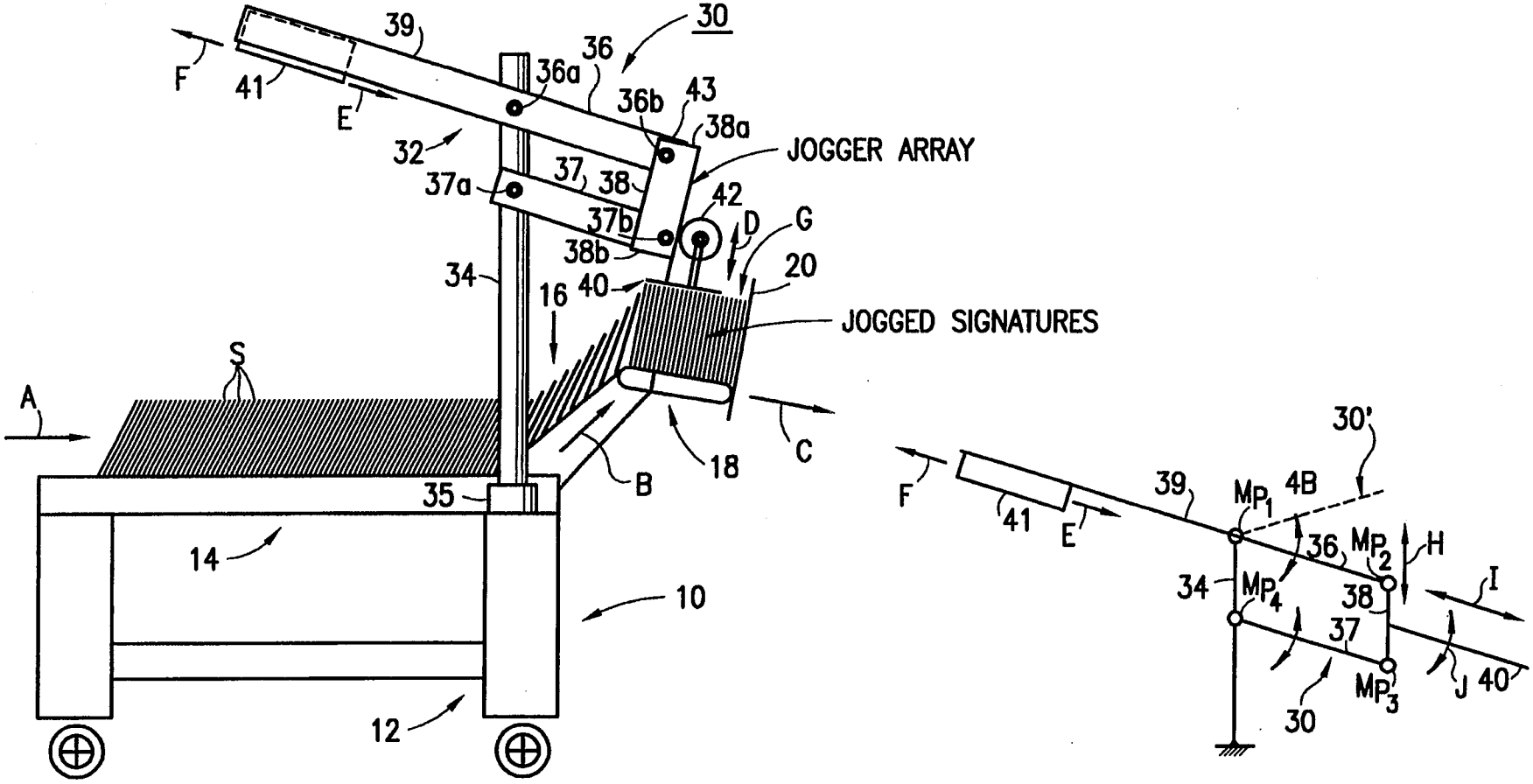
FIG. 1 is a simplified elevational view of a vertical hopper loader incorporating the floating top jogger assembly of the present invention.
FIG. 1*a* shows a simplified, diagrammatical view of the jogger mounting assembly of FIG. 1 which is useful in explaining the manner in which the orientation of the jogger assembly jogger plate is maintained regardless of swinging movement of the mounting assembly.

FIG. 1 shows a simplified view of a vertical hopper loader 10 which includes a wheeled support frame 12 having a first substantially horizontally aligned conveyor section 14 for conveying signatures S in the direction shown by arrow A. A hopper loader suitable for use with the present invention is described in detail in U.S. Pat. No. 5,197,590 and incorporated herein reference thereto.

Stacks of signatures are typically manually placed upon the first conveyor section with their folded edges up. The signatures are maintained in a substantially diagonal alignment and move in the direction of arrow A toward a second conveyor section 16 which moves the signatures diagonally upward and to the right as shown by directional arrow B. Movement of signatures S along conveyor path 16 serves to separate adjacent signatures from one another preparatory to their movement to the final output conveyor section 18 which supports and engages the folded edges of signatures S with the cut edges being substantially aligned along the top of the group G of signatures being formed upon the upper run of conveyor section 18. The signatures are advanced by conveyor section 18 so as to be moved either horizontally or in a slightly diagonally downward direction as shown by arrow C.

The signatures S in the signature group G are incrementally stepped toward a limit plate 20 by apparatus described in detail in U.S. Pat. No. 5,197,590. Signatures are typically extracted, one at a time, once they reach the limit plate, for example, by suction means shown in U.S. Pat. No. 5,197,590 (see FIG. 6) and are fed to an output utilization device such as, for example, a bindery or stitching saddle. It is extremely important that each signature be accurately aligned upon arrival at limit plate 20 in order to be assured that it will be accurately picked up and fed to the output utilization device. The vertical hopper loader serves this function together with the jogger assembly 30 of the present invention. Although the first, second and third conveyor sections 14, 16 and 18 respectively provide a substantially neat alignment of signatures in group G as they are advanced to limit plate 20, the desired precise alignment is further assured through the use of jogger assembly 30 which employs a jogging plate 40 reciprocated by a drive motor 42 to move in the direction shown by double-headed arrow D to jog the top folded edges of signatures in group G as they are advanced in the direction shown by arrow C along conveyor section 18, thus, assuring that the top folded edges are substantially in perfect alignment preparatory to reaching limit plate 20.

Heretofore, jogger assemblies employing a jogging plate utilized adjustment means for adjusting the jogging plate according to the angular orientation as well as the distance of the jogging plate above the surface of conveyor section 18, which is a function of the height of the signatures being collected. One such jogger assembly and the adjustment means therefor is described in the aforementioned U.S. Pat. No. 5,197,590.

The present invention provides a novel floating assembly 30 which is of a four-bar linkage type and is comprised of a support post 34 having its lower end secured to the hopper loader support structure by suitable support means 35. A pair of "bars" 36 and 37 are swingably mounted to post 34 by pivots at their ends 36*a*, 37*a*. A fourth "bar" 38 has its upper end 38*a* pivotally coupled by suitable coupling means 36*f*, 46 to the free end 36*b* of bar 36 (see FIG. 2*a*). The lower end 38*b* of bar 38 is pivotally coupled by coupling means 38*f*, 46 to the right-hand, free end 37*b* of bar 37 (see FIG. 2*a*).

Bar 36 is provided with an extension 39 extending to the left of support post 34 and provided with a mass 41 which is mounted to slide in either of the two directions shown by arrows E, F. Releasable fastening means (to be more fully described) serve to maintain mass 41 at any desired position along the permissible length of travel provided by means to be more fully described.

Adjustment means, to be more fully described, permit adjustment of the jogging plate shown by double-headed arrows H, I and J in FIG. 1*a*.

Assuming the orientation of the plate 40 to be as shown in FIG. 1*a*, the novel operation of the four-bar linkage is as follows:

Omitting the description of extension bar 39 and slidable mass 41 for the moment, the pivotal mounts $MP_1$ through $MP_4$ provided to swingably mount each of the bars to at least two associated adjacent bars cause the assembly to swing clockwise about the pivotal mounts $MP_1$, $MP_4$ coupling bars 36 and 37 to post 34 due to the weight of the linkage assembly as well as the weight of the jogger assembly mounted thereto.

Any irregularities or differences along the top edges of the signatures within group G (see FIG. 1) will exert an upward force against jogging plate 40 causing the plate to move upwardly. The pivotal mounts $MP_1$ through $MP_4$ freely permit this movement, further preventing the signatures from either being damaged or unduly curled.

The movement of arms 36 and 37 in either the clockwise or the counterclockwise direction has no effect whatsoever upon the angular orientation of bar 38 which remains parallel to vertically aligned post 34 regardless of the amount or direction of angular movement experienced by bars 36 and 37 within the normal range of movement. As a result, the surface of jogging plate 40 likewise always remains parallel to its nominal position, shown in solid line fashion in FIG. 1*a*.

Force exerted upon the top edges of signatures in the group G is a function of the weight of bars 36, 37 and 38 as well as the jogger assembly 30. This force may be counterbalanced and/or reduced by adjustment of slidable mass 41 with the counterbalancing force being a function of the weight of mass 41 and the distance of mass 41 from the upward pivotal mount $MP_1$ joining extension 39 and bar 36 to post 34. This arrangement permits the force exerted by the jogger assembly 30 upon the top folded edges of the signatures to be adjusted within predetermined limits. For example, in one preferred embodiment, the force exerted by plate 40 upon the top edges of the signatures in group G may be altered from a range of from one ounce to five pounds.

Figures 2A, 2C:
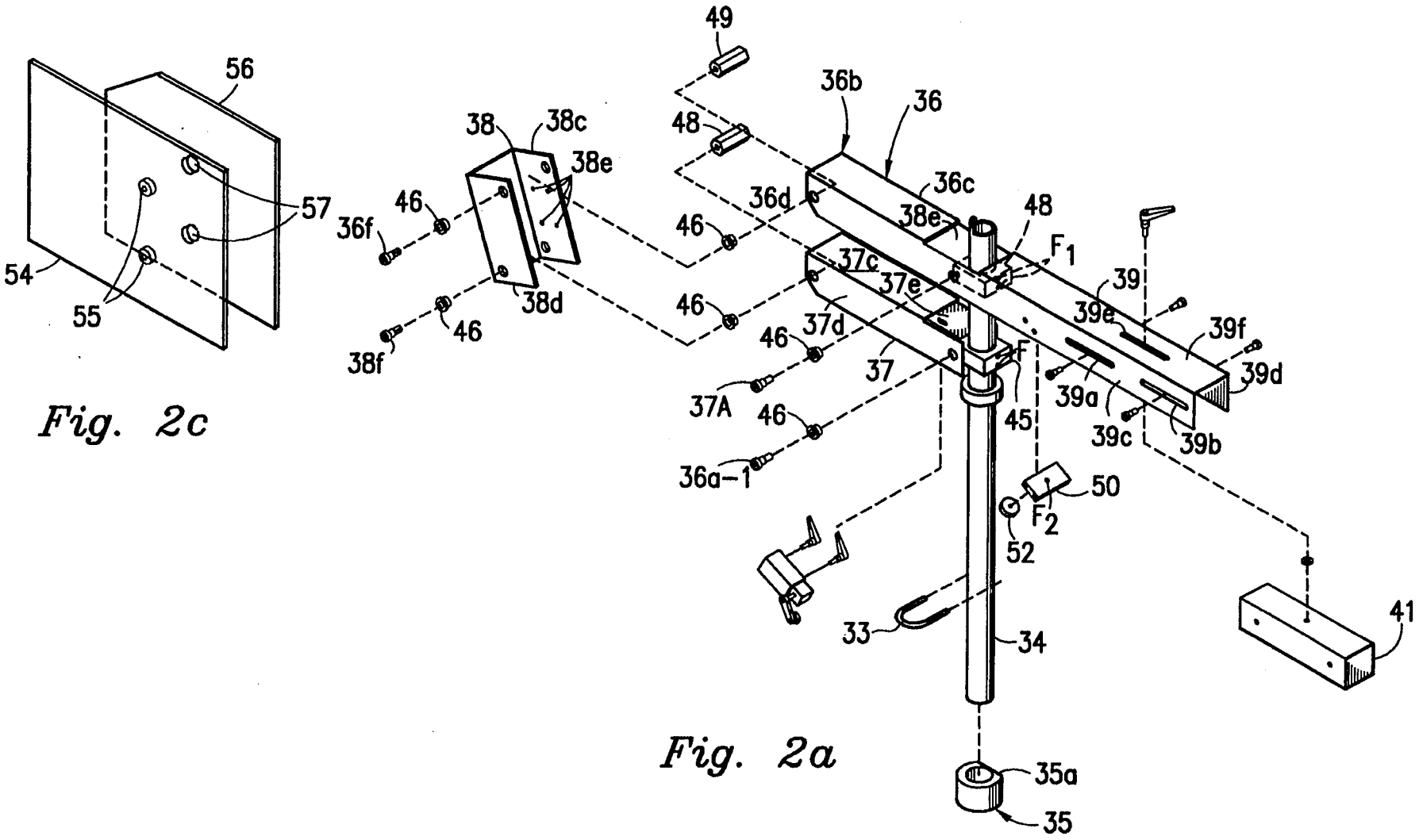
Figure 2B:
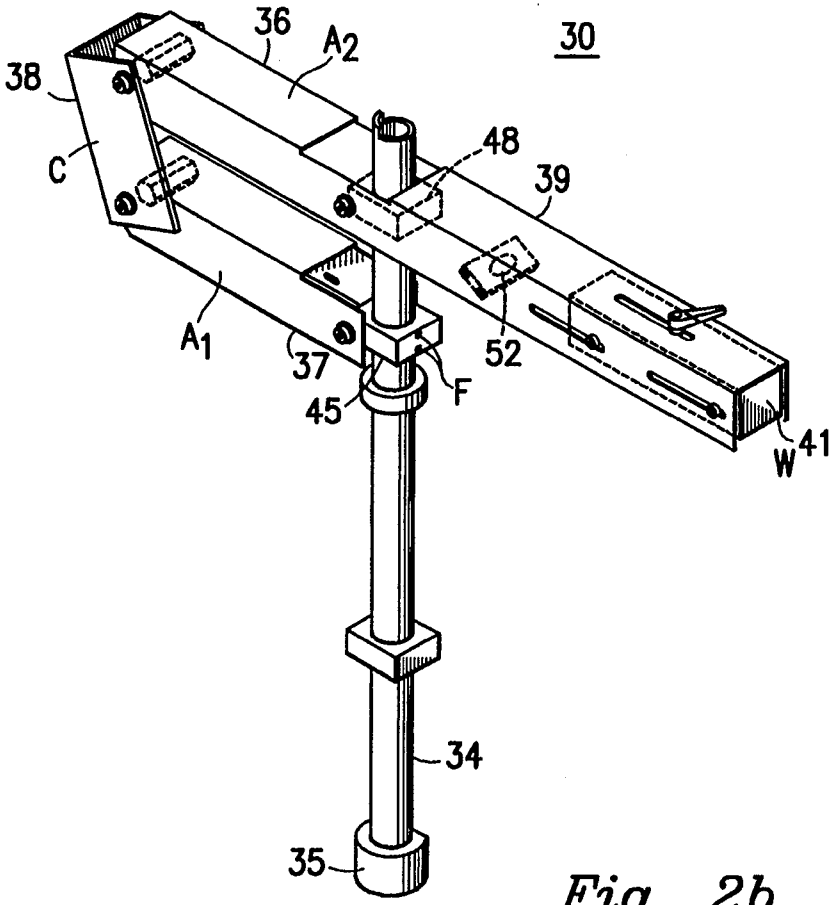
FIG. 2*b* is a detailed assembled perspective view of the support assembly of FIG. 2*a;*
Figure 3A:
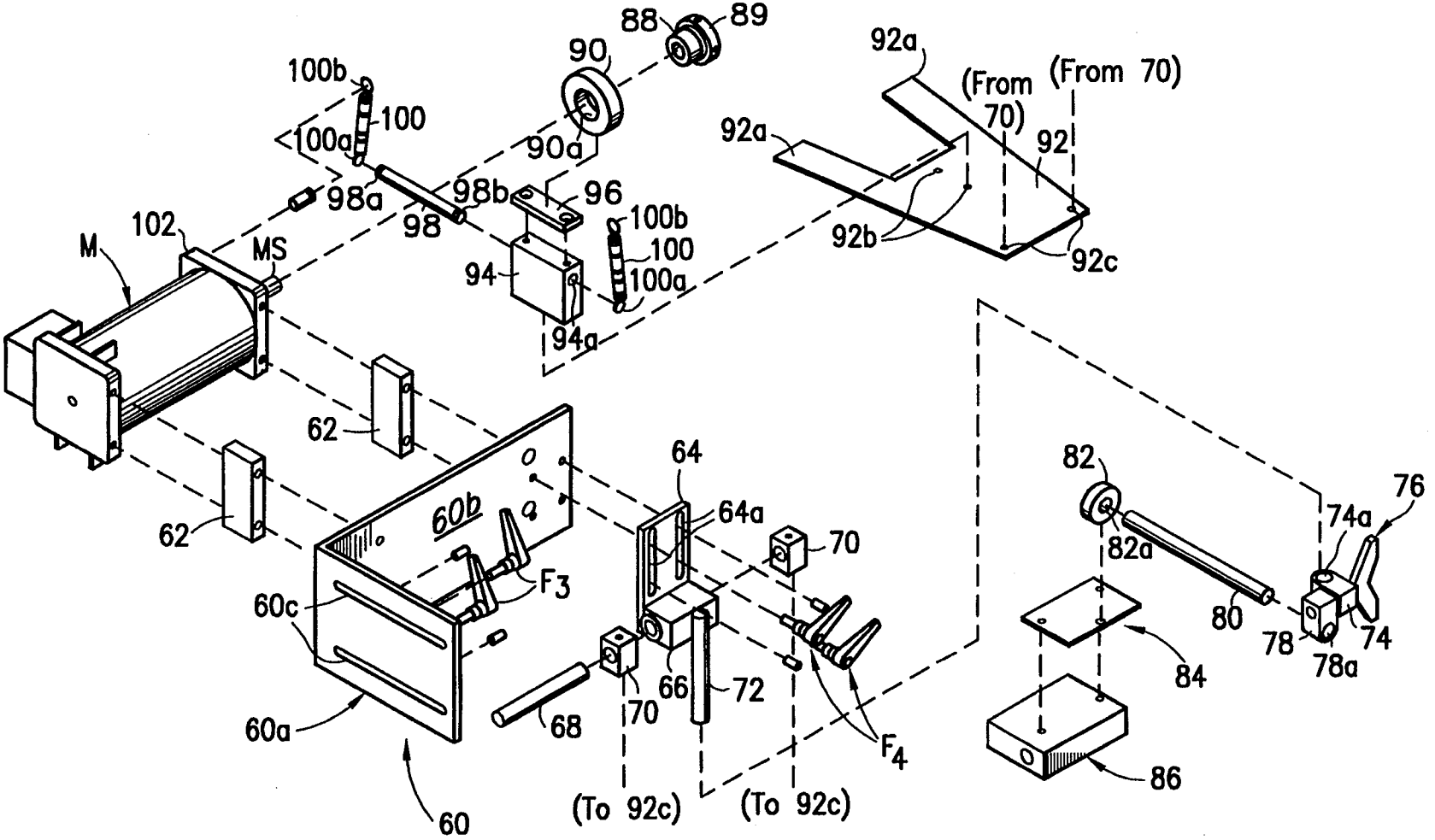
* and FIGS. 3*a* and 3*b* are exploded perspective and assembled perspective views of the jogger assembly.
Figure 3B:
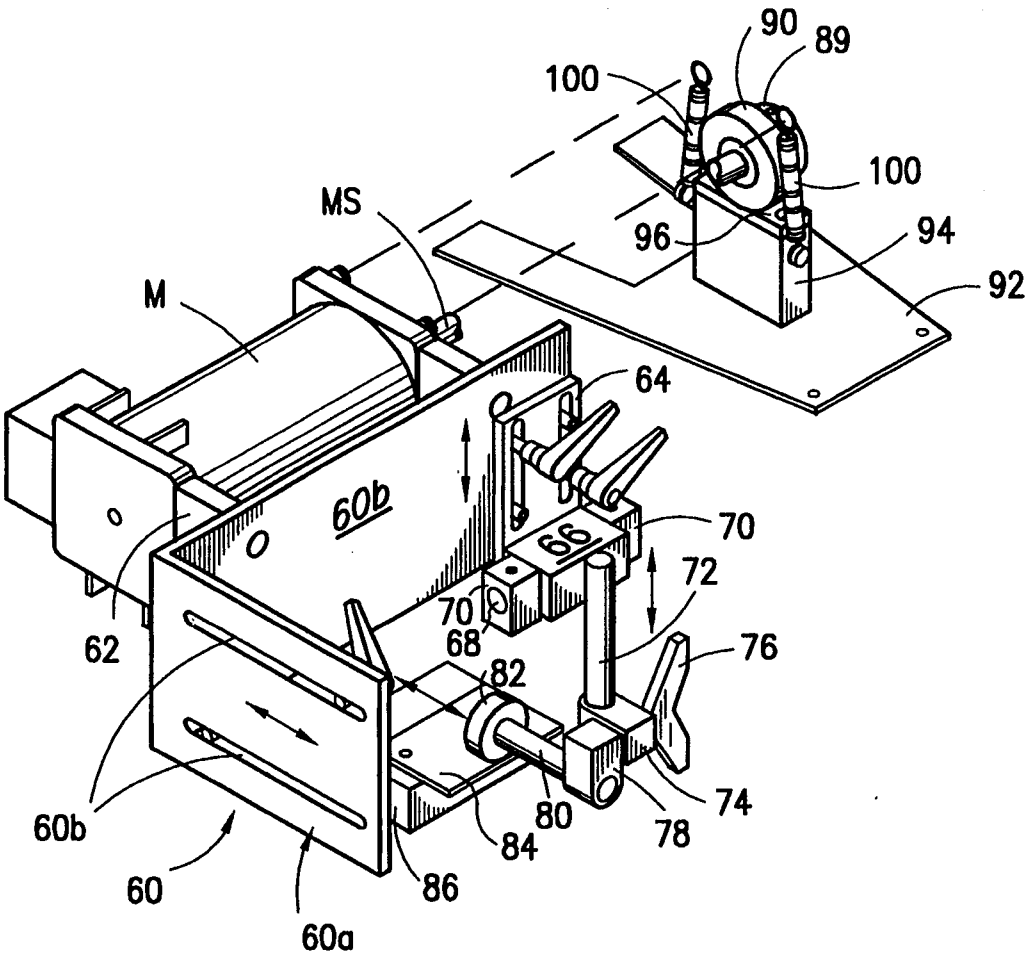

FIG. 2*a* shows a detailed exploded view of the support assembly 30 and FIG. 2*b* shows a detailed assembled view, both in perspective, of the jogger assembly floating support in which like numerals as between FIGS. 1 and la and FIGS. 3*a* and 3*b* designate like elements.

The lower end of support post 34 is swingably mounted in a cup-shaped support 35 having a flat surface 35*a* joined to the hopper loader frame 14 as shown in FIG. 1. U-shaped member 33 is secured to frame 12 (see FIG. 1) to further support post 34 and prevent rotation about its longitudinal axis. The side walls 37*c*, 37*d* of arm 37 are pivotally mounted to block 45 arranged at a predetermined position along post 34. Fasteners F retain block 45 at the desired position. Fasteners such as 36*a*-1, which include a collar 46, swingably mount the right-hand end of arm 37 to block 45. The side walls 36*c*, 36*d* of arm 36 are mounted to a similar block 48 secured at a predetermined height along post 34 by fasteners $F_1$. "Bar" 38 is a channel-shaped member having sides 38*c*, 38*d* arranged on opposite sides of bars 36 and 37. Fasteners 36*f*, 38*f* couple the channel side 38*d* to bars 36 and 37. Side 38*c* is secured to the opposite sides of bars 36 and 37 in a similar manner and utilizing similar fasteners (not shown for purposes of simplicity). Collars 46 provide the desired pivotal motion of bars 36, 37 and 38. Spacers 49 are arranged to span between the vertical sides 36*c*, 36*d* of channel-shaped bar 36 and 37*c*, 37*d* of channel-shaped bar 37.

Cut-out portions 36*e* and 37*e* in the top surface of channel-shaped bars 36 and 37 provide adequate clearance for mounting blocks 45 and 48 to permit the linkage assembly to move along its normal swing path between position 30 and 30' (see FIG. 1*a*) without interference.

Extension 39 of bar 36 is integral with bar 36 and is a channel-shaped member provided with elongated slots 39*a*, 39*b* along side surface 39*c*. Similar slots (not shown) may be provided along side surface 39*d*. An elongated slot 39*e* is provided in the top surface 39*f* of channel-shaped extension 39. Mass 41 is slidably mounted between the sides 39*c* and 39*d* of channel-shaped extension 39 and is adjustable over a predetermined distance which is equal to the length of the slots 39*a*, 39*b*, 39*e*, the length of these slots being equal to one another.

A permanent magnet member 52 is secured to bracket 50 which in turn is positioned to span between sides 39*c* and 39*d* of extension 39. Suitable fastening means (not shown) secure bracket 50 to extension 39. Fastening means $F_2$ secure permanent magnet 52 to mounting bracket 50.

A switch PS is mounted upon mounting block 44 (see FIG. 2*b*) and is activated by permanent magnet 52 when the four-bar linkage is pivoted counterclockwise in order to lift the jogger assembly upward and away from the signature stack being formed (see dotted line position 30' in FIG. 1*a*), the lifting of bars 36, 37, and 38 causing the lowering of extension 39 to position the permanent magnet 52 in close proximity to switch PS which automatically turns off the jogging assembly. The proximity switch PS activates to turn off motor M (see FIG. 3*a*) when the extension forms an angle of the order of 15° with vertical post 34.

Channel-shaped "bar" 38 is provided with mounting openings 38*e* in side wall 38*c* for adjustably mounting the jogger assembly to be more fully described in connection with FIGS. 3*a* and 3*b*.

FIGS. 3*a* and 3*b* show a jogging assembly 42 which is comprised of an L-shaped mounting bracket 60 having elongated slots 60*c* provided in arm 60*a*. Adjustable fasteners $F_3$ threadedly engage tapped openings 38*e* in side 38*c* of channel 38 shown in FIG. 2*a* to adjustably mount bracket 60 to channel-shaped bar 38. Motor M is mounted upon a pair of mounting blocks 62, 62 which are in turn secured to the arm 60*b* of bracket 60.

A bracket 64 is slidably mounted on the surface of bracket arm 60*b* opposite the surface facing motor M and is provided with elongated slots 64*a* for receiving adjustable fasteners $F_4$ for adjusting the vertical position of bracket 64 along bracket arm 60*b* to thereby adjust the angular orientation of jogging plate 92 as will be more fully described. A solid block 66 is integrally joined to bracket 64 and is provided with a substantially horizontally aligned elongated opening for slidably receiving rod 68 which is held between a pair of blocks 70, 70.

Blocks 70, 70 are secured by suitable fasteners (not shown) to the right-hand end of jogging plate 92, the fasteners extending through mounting openings 92*c* in plate 92. Plate 92 and blocks 70, 70 are swingable about the longitudinal axis of rod 68 which freely rotates relative to block 66. The position of bracket 64 relative to the motor output shaft MS determines the angular orientation of jogging plate 92.

An elongated rod 72 has its upper end joined to the right-hand surface of block 66 and extends downwardly and through an opening 74*a* in adjustable block 74 which is provided with a fastener 76 having a butterfly-shaped adjustment head to adjust the position of block 74 along vertically oriented rod 72. Block 78 is integrally joined to one face of block 74 and is provided with an opening 78*a* for receiving the right-hand end of an elongated rod 80 whose left-hand end extends into an opening 82*a* in disk-shaped member 82. Plate 84 secures disk-shaped member 82 to a sensing means 86 which projects a signal toward the stack of signatures building on conveyor section 18 (see FIG. 1) and is provided with a sensor for detecting a signal reflected off the surface of a signature to maintain the jogging assembly energized. When the signatures are greater than a predetermined distance from the sensor, the sensor deenergizes the jogger assembly to thereby provide operation of the jogging plate only when signatures are in the region of influence of the jogging plate. Adjustable blocks 74 and 78 permit adjustable movement of the sensing means 86 in mutually perpendicular directions in order to adjust the sensor according to the size of signatures being collected and jogged.

Motor shaft MS of motor M has mounted thereto an eccentric 88 which extends through the center 90*a* of ring-shaped member 90. Flange 89 at the free end of eccentric 88 retains the ring-shaped member 90 on eccentric 88.

The jogging plate 92, referred to as a "beaver-tail" due to its shape, is mounted to the underside of block 94 by suitable fasteners cooperating with openings 92*b*. A plate 96 is secured by suitable fasteners to the upper surface of block 94 and engages the periphery of ring-shaped member 90. An elongated rod 98 extends through a horizontally aligned opening 94*a* in block 94. A pair of tension springs 100 each have their lower ends 100*a* secured to opposite ends 98*a*, 98*b* of elongated rod 98 which rod ends extend beyond the adjacent vertical sides of block 94. The upper ends 100*b* of tension springs 100 are secured to a mounting plate 102 at the right-hand end of motor M. Thus, block 94 and hence the jogging plate are resiliently urged toward the ring-shaped member by springs 100.

Energization of motor M rotates eccentric 88 causing the bifurcated ends 92a of beaver-tail plate 92 to rotate in a reciprocating manner about pivot rod 68 to repeatedly strike the top edges of the jogger signatures as shown in FIG. 1 and thereby bring the signatures into precise alignment in readiness for take away of each signature as it reaches the limit plate 20.

The force exerted upon the top edges of the signatures by jogging plate 92 is a function of the weight of the jogger assembly and four-bar linkage.

This force is at least partially counterbalanced by adjustment of the slidable mass 41 along extension arm 39 whereby movement of mass 41 further away from post 34 increases the moment arm defined by mass 41 and extension arm 39 to counterbalance at least a portion of the force exerted by the jogging plate 92 (FIG. 3*a*) upon the signatures.

A safety shield 104 shown in FIG. 2*c* is secured to bracket 60*b* and acts as a safety shield to protect operators from injury by preventing operators from inserting a finger, hand or arm into the open region surrounded by the members 36, 37 and 38 of the linkage assembly which collapse when the support assembly moves to the upper, displaced position, reducing the size of the opening region.

The jogging plate 92 (FIG. 3*a*) may be adjusted to accommodate signature runs of different sizes. Once the jogging plate is adjusted, the jogging plate is maintained parallel to its initial adjustment position regardless of the swinging motion experienced by the linkage about pivot blocks 45 and 48. The freewheeling mounting assembly enables the jogging assembly to be freely lifted up in the event of any blockage or obstruction in the path of the jogging plate.

The sensing means 86 permits motor M to be energized only in the presence of signatures on conveyor section 18 and in the absence of signatures automatically turns motor M off. The jogging assembly may be easily lifted upward for inspection, maintenance or any other purpose whereupon movement of extension arm 39 to form an angle of the order of fifteen degrees (15°) with post 34 causes permanent magnet 52 to activate the proximity switch PS to automatically deenergize motor M when the jogging assembly is lifted upward and away from the jogging region.

A pair of guards 54, 56 are mounted on opposite sides of the four-bar linkage and have mounting members 55 and 57 which snap onto the heads of shoulder bolts 36*f*, 37*f* on opposite sides of the four-bar linkage in order to protect operating personnel.

The floating assembly 30 may be employed in any application where it is desired to maintain orientation of an element or device throughout a range of swingable movement as well as at least partially counter-balancing the weight of such element or device. For example, the element may be a feeler arm for sensing the top, side or bottom edges of a stack, a collector or a dispenser for a liquid, etc.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Jogger means for use in forming a neat stack of signatures as they are moved along conveyor means for receiving signatures in side-by-side, substantially upright fashion, wherein said signatures are arranged with major faces of adjacent signatures in engagement and being inclined at a slight angle to the vertical;

said jogger means including in combination:

a reciprocating jogging member engaging upper edges of signatures as they move onto said conveyor means for maintaining a neat, orderly alignment of the signatures as they move from an input end to and output end of the conveyor means;

a support assembly for adjustably mounting said jogging member at a preselected orientation, said support assembly being comprised of:

a support post;

a mounting assembly for floatingly mounting said jogging member being swingably mounted upon said post; and said mounting assembly including means for maintaining said jogging member at a predetermined orientation even when said mounting assembly swingably moves relative to said support post.

2. The jogger means of claim 1 wherein said means for maintaining comprises a four-bar linkage assembly.

3. The jogger means of claim 1 wherein said means for maintaining comprises a parallelogram linkage assembly.

4. The jogger means of claim 1 wherein said means for maintaining comprises a linkage assembly comprised of a pair of arms each having a first end pivotally mounted to said post a given distance from one another by first and second pivotal couplings;

a third arm having a first end pivotally coupled to a second end of said first arm at a third pivotal coupling and having a second end pivotally coupled to a second end of said second arm at a fourth pivotal coupling; and the spacing between said four pivotal couplings being chosen to form a parallelogram linkage, so that said third arm remains substantially parallel to said post even as said first and second arms swing relative to said post.

5. The jogger means of claim 1 wherein said means for maintaining comprises a linkage assembly comprised of a pair of arms each having a first end pivotally mounted to said post a given distance from one another by first and second pivotal couplings;

a third arm having a first end pivotally coupled to a second end of said first arm at a third pivotal coupling and having a second end pivotally coupled to a second end of said second arm at a fourth pivotal coupling; and the spacing between said four pivotal couplings being chosen to maintain said third arm substantially parallel to said post as said first and second arms swing relative to said post.

6. The jogger means of claim 5 wherein said jogging member is adjustably mounted to said third arm.

7. The jogger means of claim 5 further comprising:

said jogging member being a jogger paddle;

a support bracket adjustably mounted upon said third arm;

a motor mounted on said bracket and having a rotatable output shaft;

means coupled between said motor output shaft and said jogger paddle for converting rotation of said output shaft into reciprocating motion for reciprocating said jogger paddle.

8. The jogger means of claim 7 further comprising:

manually operable means mounted to said bracket for adjusting the position of at least one of said paddle and said motor for adjusting a spacing distance of said paddle relative to a conveying surface of said conveyor means.

9. A jogger assembly for jogging upper edges of signatures as they are moved along a substantially horizontal path defined by a conveyor with major faces of signatures on said conveyor in engagement;

said jogger assembly comprising in combination:

a jogging member engaging top edges of said signatures and means for reciprocating said jogging member to jog signatures on said conveyor into alignment;

a support assembly for floatingly mounting said jogging member and said means for reciprocating including amounting post;

said support assembly including a support means swingably mounted to said post at a location intermediate opposing ends of said support means;

said jogging member being adjustably mounted at one of said opposing ends;

a mass movably mounted to said support means and slidable along said support means in a region between said intermediate location and an end of said support means opposite from the end supporting said jogging member; and means for releasably maintaining a position of said movable mass to adjustably counterbalance at least a portion of the force exerted upon said one of said opposing ends.

10. The jogger assembly of claim 9 wherein said swingably mounted support means is movable to move said jogging member between a lower position for engaging and jogging signatures and an upper position displaced from the jogging position; and sensor means mounted on said mounting post for sensing a position of said support means for deenergizing said means for reciprocating when said support means is in the upper displaced position.

11. The jogger assembly of claim 9 wherein said support means further includes means for maintaining said jogging member in a given orientation over a range of swingable movement of said jogging member between a lower and upper position.

12. The jogger assembly of claim 9 further comprising a sensor means adjustably mounted upon said support means for sensing the presence of signatures on said conveyor and including means for energizing said means for reciprocating only when signatures are present on said conveyor.

13. The jogger assembly of claim 11 wherein said means for maintaining a given orientation of said jogging member comprises a four-bar linkage assembly.

14. The jogger assembly of claim 11 wherein said means for maintaining a given orientation of said jogging member comprises a parallelogram linkage assembly.

15. The jogger assembly of claim 9 further comprising means for adjustably mounting the jogging member on said support means for adjusting the position of the jogging member to accommodate signatures of different sizes.

16. In combination, a jogging device and a support assembly for floatingly mounting said jogging device for aligning a stack of mounting signatures arranged with one of their edges supported upon a conveying surface and with opposite parallel edges extending upwardly from the conveying surface;

said support assembly including a mounting post;

said support assembly further including elongated support means swingably mounted to said post at a location intermediate opposing ends of said support means;

said jogging device comprising:

a jogging member and means for reciprocating said jogging member at a regular rate for aligning said stack of signatures being adjustably mounted at one of said opposing ends to float above the opposite edges of said stack, said support means including means for maintaining a spatial orientation of said jogging member throughout a range of swinging movement of said support means.

17. The combination of claim 16 further comprising:

said device being a jogger assembly;

a mass movably mounted to said support means and slidable along said support means in a region between said intermediate location and an end of said support means opposite from the end supporting said jogging device; and means for releasably maintaining a position of said movable mass to adjustably counterbalance at least a portion of the force exerted by said jogger assembly upon said signatures.

18. The combination of claim 16 wherein said means for reciprocating comprises an electric motor having an output shaft;

an eccentric rotated by said output shaft;

a toroidal-shaped roller rollingly engaging said eccentric;

said jogging member comprising a paddle-shaped member;

a support block joined to said paddle-shaped member;

resilient means urging said toroidal-shaped member into engagement with said support block; and means for pivotally mounting said paddle-shaped member whereby energization of said electric motor causes said paddle-shaped member to reciprocate about said pivotal mounting means.

19. The combination of claim 16 further comprising:

sensor means for sensing the presence of signatures for selectively operating said means for reciprocating; and means for mounting said sensor means to said support assembly comprising means for adjustably positioning a height of said sensor and a distance of said sensor relative to said support assembly.

20. The combination according to claim 19 wherein said means for adjustably positioning comprises a mounting bracket mounted to said mounting assembly;

a first rod extending downwardly from said mounting bracket;

a member adjustably positioned along said first rod;

a second rod secured to said adjustably positionable member and oriented so as to be perpendicular to said first rod; and means for positioning said sensor along a length of said second rod.

* * * * *